United States Patent [19]

Richter

[11] Patent Number: 4,611,442

[45] Date of Patent: Sep. 16, 1986

[54] LARGE SPAN DOME

[75] Inventor: Donald L. Richter, Rolling Hills Estates, Calif.

[73] Assignee: Temcor, Torrance, Calif.

[21] Appl. No.: 730,164

[22] Filed: May 3, 1985

[51] Int. Cl.[4] ..... E04B 1/32

[52] U.S. Cl. ..... 52/81; 52/467

[58] Field of Search ..... 52/81, 80

[56] References Cited

U.S. PATENT DOCUMENTS

| | | | |
|---|---|---|---|
| 2,292,078 | 8/1942 | Inman et al. | 189/1.5 |
| 2,705,349 | 4/1955 | Shaw | 52/81 |
| 3,058,550 | 10/1962 | Richter | 189/1 |
| 3,063,519 | 11/1962 | Richter | 189/1 |
| 3,194,360 | 7/1965 | Richter | 189/2 |
| 3,330,201 | 7/1967 | Mouton, Jr. | 98/32 |
| 3,841,038 | 10/1974 | Geiger | 52/80 |
| 3,909,994 | 10/1975 | Richter | 52/63 |
| 3,916,589 | 11/1975 | Richter | 52/81 |
| 3,918,226 | 11/1975 | Naidus | 52/200 X |
| 4,143,502 | 3/1979 | Wyche | 52/745 |
| 4,194,325 | 3/1980 | Chalpin, Jr. | 52/200 X |
| 4,442,059 | 4/1984 | Boyce | 264/228 |
| 4,455,803 | 6/1984 | Kornberger | 52/395 |

FOREIGN PATENT DOCUMENTS

| | | | |
|---|---|---|---|
| 0767309 | 9/1980 | U.S.S.R. | 52/DIG. 10 |

*Primary Examiner*—Carl D. Friedman

*Attorney, Agent, or Firm*—Christie, Parker & Hale

[57] ABSTRACT

A clear-span dome for athletic stadia and the like includes a primary network of principal structural members which are interconnected to span a space to be covered and to define the principal curvature of the dome. The network members divide the principal curvature into a plurality of openings of selected configuration. The primary network is supported on foundations, around the perimeter of the space, which carry vertical and lateral loads of the dome. Each opening in the primary network is closed by a secondary dome which has its perimeter connected to the network principal members which form the perimeter of the opening. Each secondary dome has a curvature greater than the principal dome curvature. The primary network can be assembled, without use of shoring, from the perimeter of the space toward the center of the overall dome.

22 Claims, 9 Drawing Figures

LARGE SPAN DOME

FIELD OF THE INVENTION

This invention pertains to large clear-span domes useful to enclose athletic stadia and the like. More particularly, it pertains to such domes in which a primary space-spanning network of principal structural members defines the principal curvature of the dome, and in which openings in that network are closed by secondary domes having curvature greater than the principal curvature.

BACKGROUND OF THE INVENTION

The Needs Addressed

In the past decade or two, it has become increasingly common to construct new athletic stadia and the like with enclosing domes so that such stadia can be used for desired purposes without regard to local weather conditions. One of the first such large enclosed stadia in the Astrodome in Houston, Tex. The enclosing dome of that stadium has a conventional roofing system, with local support members, placed over a complex primary supporting truss and girder network which is of conventional nature. The erection of the enclosing dome of the Astrodome required extensive use of expensive shoring erected on the stadium floor. Maintenance of that dome often requires the use of scaffolding, but in any event is periodically required and is expensive. Today, at least in some areas, the construction of a stadium dome of the kind found in the Astrodome would be prohibitively expensive.

Also, there now exist through the world many stadia and the like which are now not covered or enclosed, but which could benefit significantly by being covered or enclosed. These stadia were not originally designed to support covering roof structures. Such stadia are frequently used for sporting events and the like. If such a stadium is to be covered or enclosed, it is desirable that the enclosing roof or dome structure be light in weight and be capable of being erected rapidly without the use of shoring, the presence of which interferes with use of the stadium. It is also desirable that the loads of the dome, and of loads applied to the dome, be carried in ways which do not require major and costly modifications of the existing stadium structure.

The foregoing circumstances establish that a need exists for advanced large clear-span domes which are light in weight and structurally efficient in terms of ability to support their own weight and applied loads and in terms of carrying such loads to supporting foundations, which can be erected without the use of major shoring, which upon completion require minimum maintenance, and which are so structured that such maintenance as is required can be accomplished economically. A structurally efficient dome requires a minimum number of supporting foundations, and such foundations as are required should be simple and aesthetically pleasing. The dome structure preferably should be adaptable to existing stadia which present different perimetral configurations of spaces to be enclosed, rather than itself dictating or limiting the geometry of the space to be enclosed.

REVIEW OF THE PRIOR ART

A few dome systems presently exist which have some, even many, but not all of these desirable characteristics; most limitations as exist in these dome systems are practical and economic in nature, rather than theoretical.

Geodesic dome systems typically require regular perimeter configurations, such as circular, square, pentagonal or hexagonal shapes, for their use. While geodesic systems sometimes include a network of supporting members across the space enclosed, they are primarily passive or stressed-skin systems in which loads are carried and transmitted in the shell or skin members of the dome. U.S. Pat. No. 3,058,550 describes a geodesic dome system which is frameless in that it does not require a network of supporting members, such as beams, tubes or trusses, but rather carries and transmits its own and applied loads through the formed-sheet skin members and associated struts to perimeter foundations. The dome system of U.S. Pat. No. 3,058,550 is geodesic in that the principal load carrying features of the dome are arranged along geodesic lines, i.e., lines which pass over the shortest distance between two spaced points on a surface; on a sphere, geodesic lines are arcs of great circles; the science of geodesics provides a way of subdividing a sphere so as to be completely triangulated by great circles. Thus, domes according to the philosophy of U.S. Pat. No. 3,058,550 are spherically curved stuctures; such domes have three dimensional contour within each triangulated area of the overall dome curvature. Spherical curvature of a very large span dome causes the dome to be very high unless a very large radius of curvature is used; there is an inverse relation between radius of curvature and load carrying efficiency. More significant, however, is the fact that as geodesic domes increase in size, the thickness of the skin sheet material also increases. A point is reached where increasing size makes such a geodesic dome economically less attractive than other dome systems of comparable size. Geodesic dome systems have the advantage of being constructable without the use of shoring.

Dome systems according to U.S. Pat. No. 3,909,994 have been used advantageously to enclose spaces larger than those with which pure geodesic domes can be used economically; dome systems according to this patent are designed, fabricated and erected by the assignee of this invention under the name "Polyframe". Domes of this kind use a network of interconnected extruded aluminum structural members, and cooperating connection devices, which preferably are arranged along geodesic lines to provide triangular openings which are closed by essentially flat sheet aluminum closure elements secured around their edges to the extruded structural members and connection devices. These domes have spherical curvature with essentially smooth surfaces. Theoretically, domes of this kind can be used to span large distances, but as spans increase so do the sizes of the extruded beams increase, thus producing a practical economic limit of about 450 feet (137 meters). Large extrusions are costly, and can be made in limited places subject to long delivery delays. These circumstances effectively prevent domes of this kind from being used to enclose athletic stadia and the like where span distances on the order of 700 feet (215 meters), or greater, may be encountered.

For large spans, double dome systems have been proposed in which the structural members of the domes are arranged in concentric shells interconnected by struts, thus making the structural grid into a generally spherical truss to be suitably covered. U.S. Pat. No. 3,063,519 is a variant of this approach which uses a series of small geodesic domes according to U.S. Pat. No. 3,058,550 to enclose a locally three-dimensional network of space-spanning structural members, either inside or outside the network. Where the geodesic domes are disposed outside the network of structural members, the overall dome surface has local three-dimensional contour. In either case, the shell of multiple geodesic domes is a weather skin which is supported at spaced points by the structural network which carries its own loads and those due to the weather skin. While the hexagonal perimeter of each small geodesic dome corresponds generally in shape and size to hexagonal openings in the structural network, the dome perimeters are not secured to the network to cooperate with the network in a significant load-carrying manner. Hence, the structural network is complex and relatively heavy.

It is seen, therefore, that although existing dome systems have many advantages, the are not effectively usable where large spans are encountered and do not effectively satisfy the needs and requirements described above.

SUMMARY OF THE INVENTION

This invention provides a clear-span dome structure useful, among other things, for covering athletic stadia and the like, whether of new construction or of existing construction. The dome structure can be erected quickly without the use of shoring. It is lightweight and has low maintenance requirements. It is structurally efficient in that it uses a minimum number of major structural elements, and those preferably are arranged on geodesic lines across the curvature of the dome which may be, but does not have to be spherical in nature. The dome structure is useful to enclose spaces having irregular perimeter configurations, as well as spaces having round or other regular configurations. The structure requires a small number of supporting foundations. The structural efficiency of the dome structure may be and peferably is enhanced by using the enclosing weather skin system to carry substantial portions of its weight, and of loads applied to it, to the foundations. The philosophy and rationale of the dome structure are flexible, enabling the principles of the invention to be applied to a range of sizes, configurations and purposes. The invention unobviously combines proven structural principles and systems.

Generally speaking, a dome structure according to this invention has a desired planform perimetral outline that is adapted to be supported on foundation means along that outline to provide a clear-span covering over a space bounded by the foundation means. The dome structure has a primary network of interconnected structural members, the network being supportable by the foundation means to span the space to be enclosed. The primary structural network defines a principal curvature of the dome structure, and divides that curvature into a plurality of openings having selected, and preferably similar, boundary configuration. The several openings in the principal structural network are closed by a corresponding plurality of minor dome assemblies, each of which has a curvature substantially greater than the principal dome curvature. Each minor dome assembly has a perimetral configuration substantially congruent to the boundary of its corresponding opening. Each minor dome assembly is connected essentially along the entirety of its perimeter to the adjacent members of the primary structural network for closing the corresponding opening in a weathertight manner. It required, tension means are provided which cooperate with the primary network members in association with the foundation means for carrying dome loads acting horizontally outwardly of the dome structure.

The secure connection of each minor dome assembly to the primary structural network of the dome structure enables the dome assemblies themselves to carry a substantial portion of the loads due to their weight, and of loads applied to them, to the foundation means, rather than merely being carried by the primary structural network.

In a preferred embodiment of this invention, the primary structural network is composed mainly of steel trusses which are arranged to triangulate the principal dome curvature. In this embodiment, the minor dome assemblies preferably are dome units constructed in accord with the teachings and disclosures of U.S. Pat. No. 3,909,994. If desired, however, the minor dome assemblies can be geodesic in nature (U.S. Pat. No, 3,058,550, for example) or translucent according to the teachings of U.S. Pat. No. 3,916,589, for example.

It is preferred that the trusses defining the primary structural network of the present dome structure be arranged to define catwalks to function as worker scaffolding so that workmen can walk safely inside the trusses during construction, and also after construction for access to lights and the like.

The radii of curvature of the minor domes are sized to span the openings in the primary structural network and to minimize the size of members and reduce bending stresses for optimum use of materials. The outward thrust of each of the minor domes passes over the primary structural network to substantially reduce, by as much as 40 percent, the loads which must be carried by that network.

DESCRIPTION OF THE DRAWINGS

The above-mentioned and other features of this invention are more fully set forth in the following detailed description of a presently preferred embodiment of the invention, which description is presented with reference to the accompanying drawings wherein.

DESCRIPTION OF THE ILLUSTRATED EMBODIMENT

Figure 1:
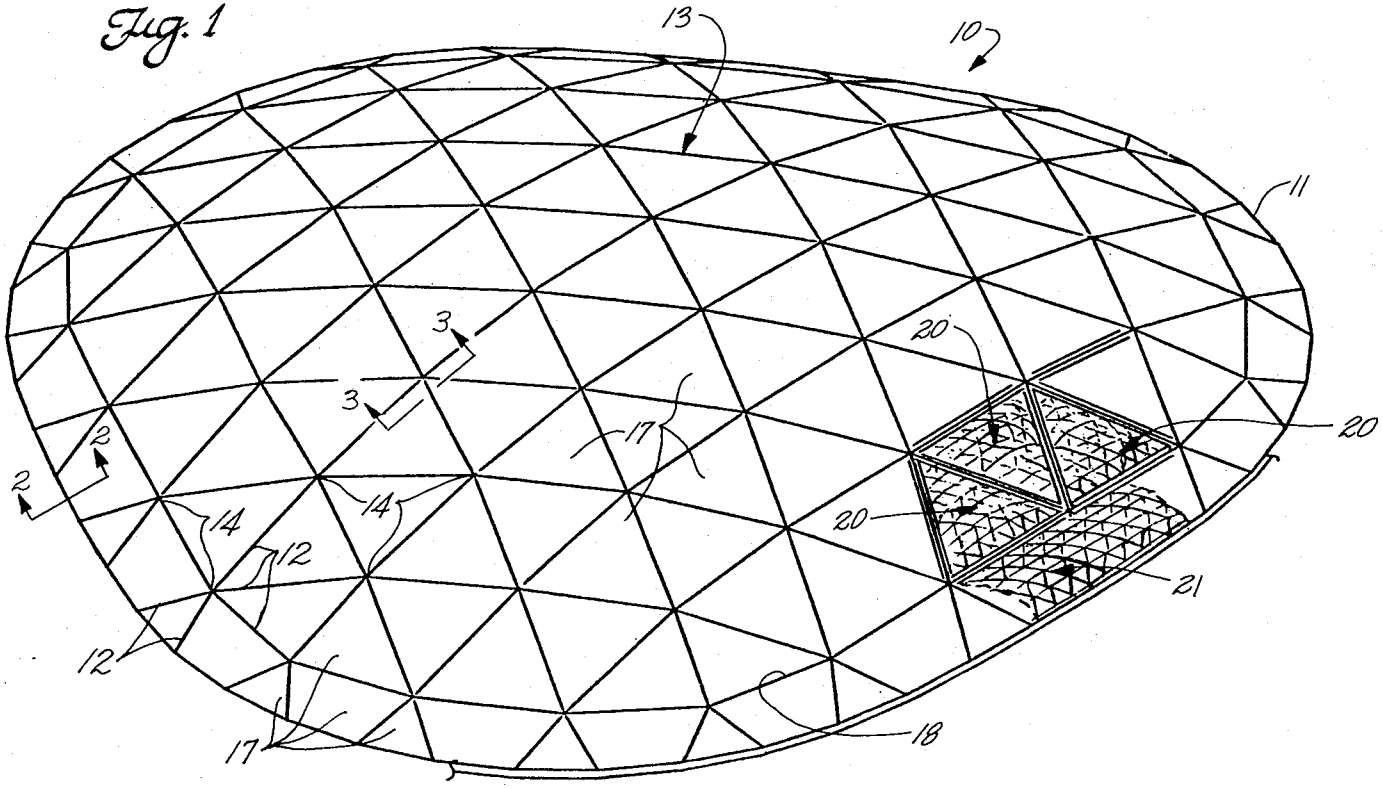
FIG. 1 is a perspective view of a dome according to this invention.

An exemplary dome 10 according to this invention is shown in simplified perspective in FIG. 1. The dome has a perimeter 11 outline which is generally in the form of an isosceles triangle having substantially rounded corners and somewhat curved sides. The overall planform dimension of the exemplary dome shown is 694 feet by 673 feet.

The illustration of FIG. 1 is simplified or idealized in that the principal lines thereof represent the positions of respective ones of a plurality of primary structural members 12 which are connected between the dome perimeter and each other to define a primary structural network 13 of the dome. The several primary structural members inwardly of perimeter 11 are connected to each other at hub points 14 where several of the members are interconnected via a hub assembly 15 (see FIGS. 3 and 4, e.g.). The presently preferred form of primary structural member is a straight truss assembly ("truss") shown in detail in FIGS. 2, 3, 4 and 5. In the present description, the terms "primary structural member", "truss assembly", and "truss" are used interchangeably (unless the context clearly indicates otherwise) in connection with reference number 12.

The several trusses of primary network 13 span the space bounded by the dome perimeter. They define a principal curvature of the dome. Also, they divide the dome's principal curvature into a plurality of openings 17 each of which has a selected boundary configuration.

The principal curvature of a dome according to this invention can be spherical, but it need not be so. It can be elliptical or of any other form desired and practicable having regard to the dome's perimeter outline, its size, and the environmental and other factors relevant. In general, however, the dome's principal curvature is convex upward.

FIG. 1 shows that the several trusses 12 of network 13 are arranged, for the most part, along geodesic lines across the dome's principal curvature; this is a preferred but not a required condition. Those geodesic lines preferably triangulate the area of the dome so that openings 17, except certain of them immediately adjacent to the dome perimeter, are triangular in shape. The triangles need not be, and in some cases cannot be, similar.

Certain of the trusses in network 13 define a ring 18 generally parallel to perimeter 11 and closely inwardly of the dome from the perimeter. It is preferred that all openings inside ring 18 be triangular openings. Depending upon the nature and location of foundations 19 (see FIG. 2) for the dome, the openings in network 13 between ring 18 and the perimeter can be, and often must be, other than triangular.

FIG. 1 also shows that each of openings 17 inside truss ring 18 is closed by a respective minor dome assembly 20. Each minor dome assembly has a curvature which is convex upwardly and which is substantially greater than the dome's principal curvature. Each minor dome 20 has a perimeter configuration which is substantially congruent to that one of openings 17 with which it is associated, and each minor dome is connected along its perimeter to the trusses and hub assemblies which define its opening to close the opening in a weathertight fashion.

The outer margins of dome 10, i.e., that part of the dome from truss ring 18 out to the perimeter of the dome, are enclosed in a weathertight fashion by a series of closures 21 which preferably are structurally defined similar to the way in which the minor domes are structurally defined.

As noted above, it is preferred that minor domes 20 and closures 21 be constructed according to the disclosures of U.S. Pat. No. 3,909,994, to which reference is made. When applied to the context of the present invention, that patent teaches that each of openings 17, and corresponding portions of the margin of the dome, are triangulated by beam-like structural members to define plural smaller triangular openings, each of which is closed by a sheet closure. The beam-like members of each minor dome are straight and are connected to hub-like gusset members which are so configured that they serve to define the curvature of the minor dome. It is within the scope of this invention, however, that minor dome constructions other than as described in U.S. Pat. No. 3,909,994 may be used to close openings 17 in network 13 of dome 10.

It will be understood that curvature and radius of curvature are inversely related. A curved surface is said to have slight curvature if it has a long radius of curvature, and to have a high degree of curvature if it has a relatively short radius of curvature. Thus, dome 10 has an overall radius of curvature which is substantially greater than the radius of curvature of any minor dome 20 present in dome 10.

Figure 3:
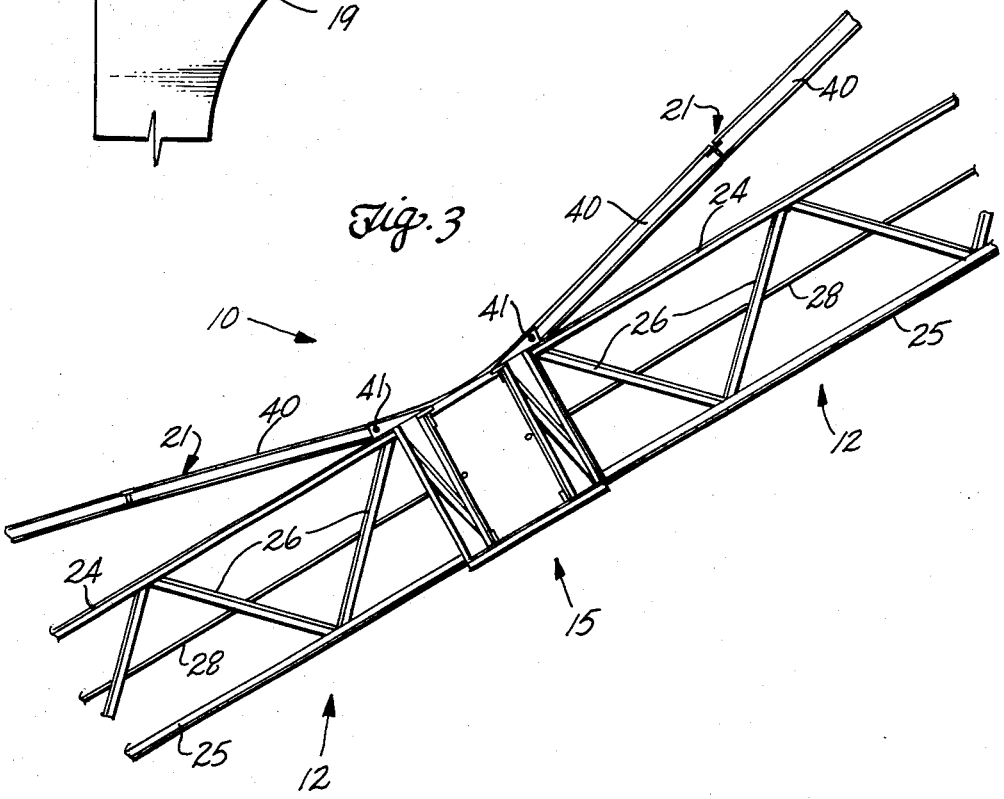
FIG. 3 is a fragmentary elevation view taken along line 3—3 in FIG. 1.
Figure 4:
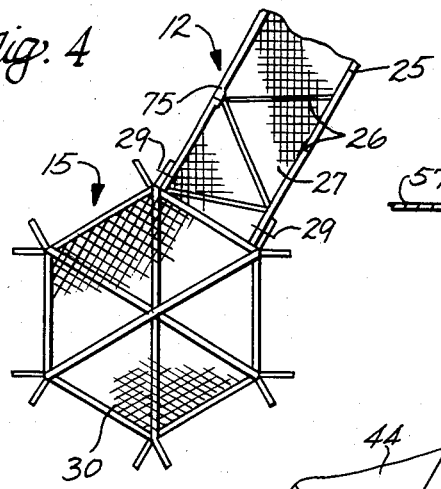
FIG. 4 is a fragmentary plan section view of an intertruss hub structure and a portion of an adjacent truss member in the primary structural network of the dome of FIG. 1.

Each of trusses 12 in the primary structural network of dome 10 is straight between its opposite ends. As shown in FIGS. 2–5, in which FIG. 4 is a plan view of a hub assembly 15, the trusses are elongate frameworks comprised of a pair of laterally spaced upper longitudinal members 24 and a pair of laterally spaced lower longitudinal members 25 which are disposed at the corners of the preferably rectangular transverse cross-section of the truss; see FIG. 5. Diagonal members 26 are interconnected between each adjacent pair of longitudinal members of each truss in each of the top, bottom and side surfaces of the truss. An expanded metal plate 27 or other lightweight grating material is laid over the diagonal members in the bottom of at least some of the trusses so that such trusses can be used as personnel catwalks for access to lights and the like inside the dome and for such maintenance of the dome as may be required over time. Hand rails 28 are also fitted along the sides of those trusses.

Hub assemblies 15 are defined as structural cages to which the trusses are connected by pinned connections 29 as shown in FIG. 4. The hub assemblies have that number of faces as there are trusses to be connected to the assembly in dome 10. As shown in FIG. 1, in dome 10 most, but not all, of the hub points are common to six trusses, and so in that dome those hub assemblies have six truss connection faces; other hub points are common to five trusses and so those hub assemblies have five truss connection faces. The bottom portion of each hub assembly carries an expanded metal plate 30 or suitable grating so that personnel can walk or stand in the assembly.

Each truss 12 and each hub assembly 15 in dome 10 is prefabricated prior to erection of the dome. Each truss and each hub assembly is individually dimensioned and configured to occupy a preassigned position and orientation in network 13. Thus, the precise geometry of each truss and hub assembly can be different from other trusses and hub assemblies. The precise individual geometrical detailing of the several trusses and hub assemblies is required to impart the desired curvature to the dome.

Figure 2:
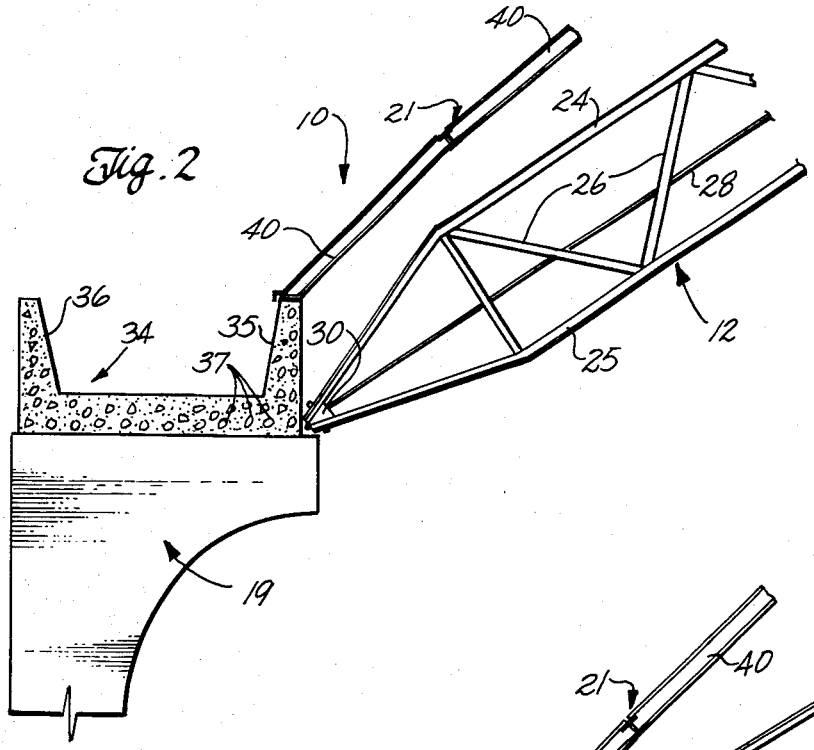
FIG. 2 is a fragmentary cross-sectional elevation view taken along line 2—2 in FIG. 1.

FIG. 2 shows that the trusses which are connected to the foundations 32 are connected to them by pinned connections 30.

Foundations 19 are provided at suitable locations along the perimeter of the dome. The foundations can be suitable structural features of the stadium or the like over which the dome is to be erected. Alternatively, the foundations can be structures installed specially for support of the dome. If the foundations individually are principally carriers of vertical loads, a perimetral base ring 34 can be carried by the foundations to extend along and define the perimeter 11 of the dome. As shown in FIG. 2, the base ring can be in the form of a concrete channel having upstanding inner and outer legs 35 and 36. Metal tension elements 37 can be embedded in the concrete to enable the ring to receive and carry loads tending to cause the ring to expand, i.e., to enable the ring to receive, distribute and carry hoop stresses. Thus, the base ring receives and distributes loads from the dome applied outwardly of the dome, so that foundations 19 receive and support essentially only vertical loads from the dome.

The channel-like configuration of base ring 34 enables it to serve as a gutter for rain shed by the dome. The outer leg 36 of the tension ring serves to mask and hide any floodlights which may be located in the ring for illuminating the dome.

The dome can be erected after all necessary foundations, and the base ring if used, have been prepared or constructed and after the necessary trusses and hub assemblies hve been constructed and made available at the dome site. Construction of the dome can be accomplished using stiff-leg cranes or A-frames along the periphery of the dome and by use of mobile cranes and the like inside the perimeter of the dome, as on the floor of the stadium over which the dome is to be erected. Shoring and scaffolding are not needed.

The dome is erected in a predetermined sequence beginning at a selected point along the perimeter of the dome. The dome is erected inwardly from the perimeter. The dome's trusses are erected in concentric circles, or approximations thereof, beginning at the dome perimeter and proceeding inwardly so that the trusses cantilever into the space to be enclosed in a self-shoring manner. As each truss 12 or hub asembly 15 is moved into its proper position in network 13, it is pinned to the pertinent foundation, hub assembly or adjacent truss or trusses. The fact that the trusses and hub assemblies can be used as catwalks and galleries for construction personnel facilitates the process of constructing the primary structural network of the dome. As each hub assembly 15 is connected to at least two of trusses 12, the corresponding hub point 14 is defined in a staticaly stable manner. Thereafter cranes, e.g., are used at that hub point only as required to lift the hub point to enable additional trusses to be connected to the corresponding hub assembly through use of the pin connections 29 described above.

The network 13 of trusses 12 and hub assemblies 15 preferably is completed before any of minor domes 20 are installed to close openings 17 in the network. The minor domes preferably are assembled, insulated and sealed on the floor of the space spanned by network 13. As they are assembled, they are hoisted into their corresponding openings and secured in place, as by use of pinned connections 41 shown in FIG. 5. Hoisting of the assembled minor domes can be done by relatively light stiff-leg cranes located at the hub points associated with the one of openings 17 which is of interest. However, as a less preferred alternative, the minor dome assemblies, particularly when constructed according to the disclosures of U.S. Pat. No. 3,909,994, can be assembled from their perimeters to their centers in much the same manner as network 13 can be defined. Assembly of each minor dome can be accomplished by the use of small, lightweight stiff-leg cranes supported at suitable locations by trusses 12 and hub assemblies 15 around the perimeter of each opening 17 to be closed by a minor dome.

Figure 9:
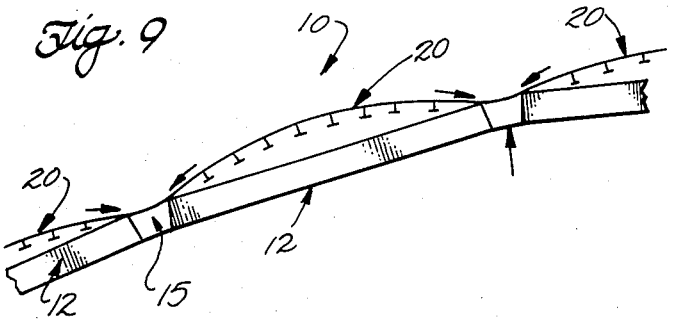
FIG. 9 is a simplified fragmentary sectional elevation view of a portion of the dome of FIG. 1 showing how the minor dome assemblies cooperate with the network of trusslike primary structural members.
Figure 5:
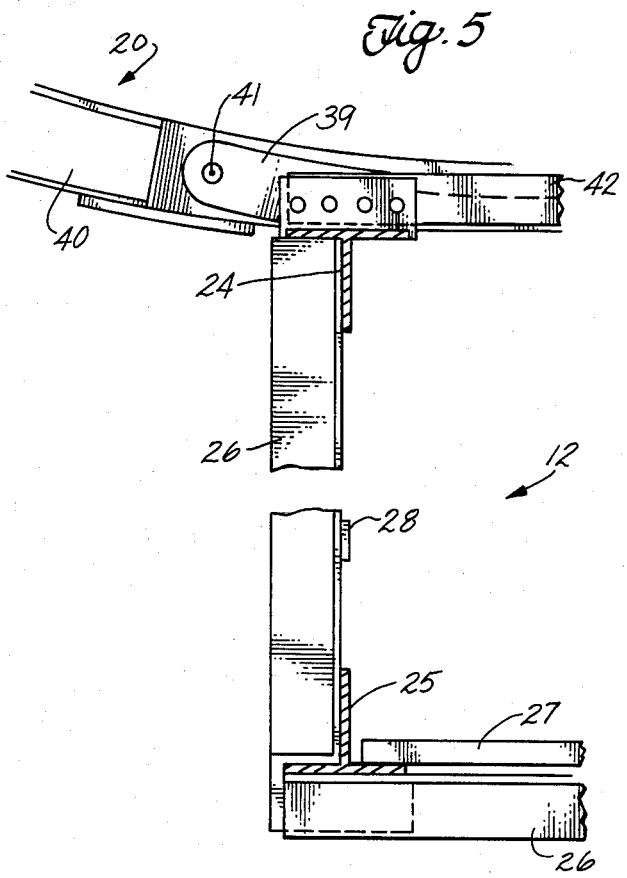
FIG. 5 is a fragmentary enlarged sectional elevation view through a truss member in the dome of FIG. 1.

The mounting of each minor dome across a corresponding opening 17 is accomplished by use of minor dome foundation members 39 (see FIG. 5, e.g.) which are carried by the upper portions of the structure of the adjacent trusses 12 to project laterally from the trusses and to which the extruded beams 40 of the minor dome are connected via pinned connections 41. The minor dome foundation members preferably are provided in aligned sets along the opposite upper edges of the trusses, and the foundation members at each station along the truss on one side of the truss are structurally interconnected with the foundation members at that station on the other side of the truss by a beam 42 disposed transversely across the top of the truss and forming a part of the truss. Similar structural connections are provided, as required, between each minor dome and the hub assemblies associated therewith. In this way, substantial portions of loads applied outwardly by each minor dome to its supporting trusses and hub assemblies are carried across the tops of the trusses and hub assemblies to the next adjacent minor dome, and so on to the dome's perimeter closures 21 and so to foundations 19 and tension ring 34; see FIG. 9. It is thus seen that a significant portion, roughly 40 percent, perhaps more, of the weight of the minor domes, and of environmental loads applied to them, are carried to foundations 19 by the minor domes themselves, and do not need to be carried by the primary structural network of dome 10. The result is that the components of network 13 can be light in weight, thus contributing to the relatively low material and construction costs of the dome.

Figure 6:
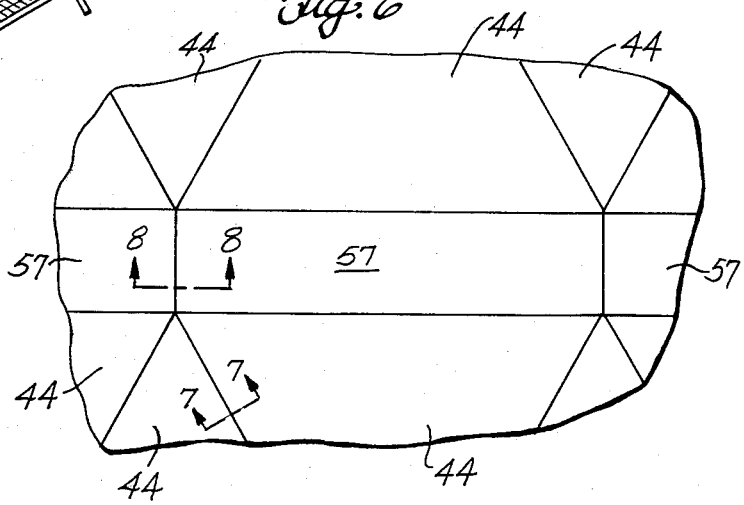
FIG. 6 is a fragmentary top plan view of a portion of the dome of FIG. 1 and shows a truss member and portions of adjacent minor dome assemblies.
Figure 7:
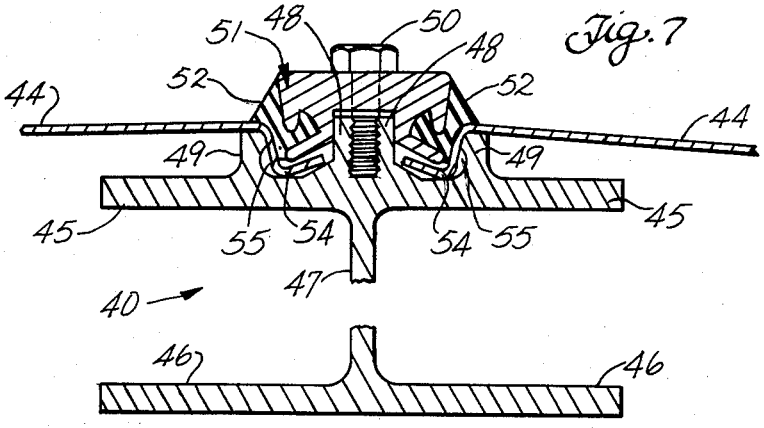
FIG. 7 is an enlarged cross-sectional elevation view taken along lines 7—7 in FIG. 6.

FIG. 7 is a fragmentary cross-sectional elevation view of a minor dome beam 40 showing the way in which the triangularly shaped pieces of sheet material 44 comprising the minor dome skin are coupled to the several beams 40 in each minor dome in the presently preferred form of dome 10. FIG. 7 is essentially identical to FIG. 6 of U.S. Pat. No. 3,909,994 to which reference is invited, especially columns 3 and 4 of the text of that patent, for a detailed description of the structure shown in FIG. 7 hereof. Each beam 40 has top and bottom flanges 45 and 46 on opposite sides of a central web 47, so that the beam roughly resembles a wide flange or I beam except for the presence centrally of top flanges 45 of two inner and two outer ribs 48 and 49 extending upwardly from the top flange symmetrically with respect to the plane of web 47. The opposing surface of inner ribs 48 are serrated to cooperate with threaded fasteners 50 which penetrate an elongate batten or retainer bar 51 at spaced locations along the bar for holding the bar on beam 40. A gasket element 52 is carried along each side of the retainer bar. The margins of each piece of sheet material 44 are doubly bent to define an offset flange 54 along each edge of the sheet.

The several pieces of sheet material 44 are closures for the triangular openings formed by the network of beams 40 and cooperating connector gusset members in each minor dome 20. After the beams 40 in each minor dome have been assembled to span across and triangulate the corresponding opening 17 in dome 10's principal structural network 13, the openings in the minor dome are closed by closure sheets 44 which preferably are defined of aluminum sheet. As each sheet 44 is put into position, its edge flanges fit into recesses 55 defined in beams 40 between each outer rib 49 and the adjacent inner ribs. Retainer bars 51 are then mated to the sheet flanges and secured to the beams by fasteners 50. As the fasteners are tightened, the gasket elements 52 forcibly engage the sheet flanges and provide a weathertight connection of the sheets to the beams.

Figure 8:
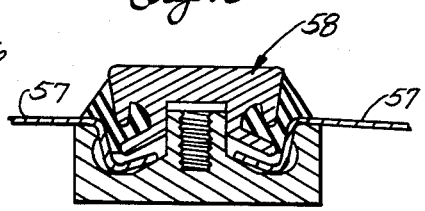
FIG. 8 is an enlarged cross-sectional elevation view taken along line 8—8 in FIG. 6.

Each truss 12 includes a connection feature similar to that shown in FIG. 7 along each of its upper edges for cooperation with rectangular truss roof cover panels 57 and with adjacent ones of the minor dome closure sheets 44. A similar connector member and retainer bar assembly 58, shown in FIG. 8, is provided transversely of each truss 12 in association with each of the aligned sets of minor dome foundation members 39 for connecting together the ends of adjacent truss cover panels 57. Each hub assembly 15 has a sheet-like cover (not shown) which is connected over the top of the hub assembly by connectors similar to those shown in FIGS. 7 and 8. Thus, upon completion of dome 10, its exterior is defined by a series of individually flat sheets, connected in a weathertight manner to the structural members of the dome principal structure network and of the minor dome.

If desired, the inner surfaces of the sheet-like dome closures (44, 57, etc.) can carry thermal insulation of desired thickness. The closures can be anodized or suitably coated for aesthetic and/or protective purposes.

It will be apparent from the foregoing descriptions that each of the perimeter closures 21 of dome 10 are structurally defined and installed in a manner similar to minor domes 20. As noted above, however, the perimeter closures extend between those of trusses 12 which define dome truss ring 18 and the foundation and base ring arrangement at the perimeter of the dome as shown in FIG. 2. Thus, the foundations at the perimeter of the dome are arranged to support the lower edges of the dome's perimeter closures 21 and to carry the loads transmitted via the minor domes and the perimeter closures.

A significant feature of a dome according to this invention is that it is composed of a primary structural frame closed by secondary mini-domes which span openings in the frame with minimal bending stress and which share loads with the primary frame to add strength to the dome. Another feature is that the primary frame can be erected with virtually no shoring; it is self-shoring. Another feature is that the mini-domes can be preassembled on the ground under the primary frame, and then hoisted into place by use of small winches and stiff legs suitably located on the primary frame. The mini-domes do not have to be assembled directly below the primary frame openings they will close. A further feature, among others, is that the primary frame serves as a construction catwalk. After construction of the dome has been completed, the dome provides ready access by personnel to all locations in the dome via the catwalks afforded by the trusses and hub assemblies. Thus, lights, sound systems, and air conditioning systems located in the dome can be reached easily for adjustment and maintenance as needed. The dome has low maintenance requirements in view of the essentially simple design philosophy and the easily reparable nature of its components. Individual closure elements in the exterior skin of the dome can be replaced easily if necessary. Also, the compound curvature of the dome, created by the more severely curved minor domes locally of the more gently curved overall dome, is aesthetically attractive and has desirable aerodynamic characteristics. The dome can be erected in relatively short time.

Persons skilled in the art to which this invention pertains will appreciate that the foregoing description, presented with reference to the embodiment of the invention which presently is preferred, is illutrative in purpose and nature and is not a catalog of all forms in which this invention can be embodied. They will also appreciate that the structures and procedures described above can be modified or altered without departing from the teachings of this invention and while beneficially using the advances and features of the invention. Therefore, the preceding descriptions, and the illustrations presented in support of those descriptions, are not to be interpreted as limiting the true and fair scope of this invention as described in the following claims.

What is claimed is:

1. A dome structure of desired planform perimetral outline adapted to be supported on foundation means along said outline and to provide a clear-span covering over a space bounded by the foundation means, the dome structure comprising A. a primary network of interconnected structural members adapted to be supported by the foundation means for spanning the space bounded by the foundation means, for defining a principal curvature of the dome structure, and for dividing the principal curvature into a plurality of openings of selected boundary configuration, and B. a corresponding plurality of discrete minor dome assemblies each having a curvature substantially greater than the principal curvature of the dome structure, each minor dome assembly having a perimetral configuration substantially congruent to the boundary configuration of the corresponding opening and connected essentially along the entirety of its perimeter to the primary network for closing the corresponding opening in a weathertight manner.

2. A dome structure according to claim 1 wherein the structural members of the primary network are arranged at least predominantly along geodesic lines across the principal curvature of the dome structure.

3. A dome structure according to claim 2 wherein said geodesic lines are interrelated to define said openings at least predominantly as substantially triangular openings.

4. A dome structure according to claim 1 wherein said openings in the primary network are defined at least predominantly as substantially triangular openings.

5. A dome structure according to claim 1 including means along the boundary of at least some of said openings for carrying loads of a minor dome assembly associated with a corresponding opening across a structural member bounding the opening to an adjacent minor dome assembly.

6. A dome structure according to claim 1 wherein the structural members comprise elongate straight truss assemblies and hub assemblies, the hub assemblies being adapted for interconnecting plural ones of the truss assemblies.

7. A dome structure according to claim 6 wherein the truss assemblies are aligned along substantially geodesic lines across the principal curvature.

8. A dome structure according to claim 7 wherein the hub assemblies are located at intersections of the geodesic lines.

9. A dome structure according to claim 6 wherein at least some of the truss and hub assemblies define personnel catwalks.

10. A dome structure according to claim 6 including pin connection means for interconnecting the truss and hub assemblies.

11. A dome structure according to claim 6 including means on at least some of the truss assemblies for supportive connection to an adjacent minor dome assembly and for transfer of loads from that minor dome assembly across the truss assembly to another adjacent minor dome assembly.

12. A dome structure according to claim 6 wherein the truss assemblies are of open framework construction and have substantial width and depth, and including means for closing the tops of the truss assemblies in a weathertight manner.

13. A dome structure according to claim 12 wherein the means for closing the tops of the truss assemblies comprise substantially flat sheet members.

14. A dome structure according to claim 1 including tension means cooperating with the primary network in association with the foundation means for carrying dome structure loads acting horizontally outwardly thereof.

15. A dome structure of desired planform perimetral outline adapted to be supported on foundation means along said outline and to provide a clear-span covering over a space bounded by the foundation means, the dome structure comprising A. a primary network of interconnected structural members adapted to be supported by the foundation means for spanning the space bounded by the foundation means, for defining a principal curvature of the dome structure, and for dividing the principal curvature into a plurality of openings of selected boundary configuration, and B. a corresponding plurality of minor dome assemblies each having a curvature substantially greater than the principal curvature of the dome structure, each minor dome assembly having a perimetral configuration substantially congruent to the boundary configuration of the corresponding opening and connected essentially along the entirety of its perimeter to the primary network for closing the corresponding opening in a weathertight manner, C. the minor dome assemblies being comprised of a secondary network of structural members spanning the corresponding primary network openings and dividing the minor dome curvature into a plurality of apertures, and closure means cooperating with the secondary network for closing said apertures.

16. A dome structure according to claim 15 wherein the structural members comprise elongate straight truss assemblies and hub assemblies, the hub assemblies being adapted for interconnecting plural ones of the truss assemblies.

17. A dome structure according to either of claims 15 or 16 wherein the structural members of each minor dome secondary network are arranged at least predominantly along geodesic lines across the curvature of the minor dome.

18. A dome structure according to claim 17 wherein said geodesic lines are interrelated to define said apertures at least predominantly as substantially triangular openings.

19. A dome structure according to claim 18 wherein the closure means comprise substantially sheet-like elements disposed across the apertures.

20. A dome structure according to claim 19 wherein each sheet-like element is essentially flat inwardly of its margins.

21. A dome structure according to claim 15 wherein the closure means comprise substantially flat sheet-like elements disposed across the apertures.

22. A dome structure of desired planform perimetral outline adapted to be supported on foundation means along said outline and to provide a clear-span covering over a space bounded by the foundation means, the dome structure comprising A. a primary network of structural members adapted to be interconnected in a predetermined manner and to be supported by the foundation means for spanning the space bounded by the foundation means, for defining a principal curvature of the dome structure, for dividing the principal curvature into a plurality of openings of selected boundary configuration, and for carrying to the foundation means loads of and applied to the primary network, B. a corresponding plurality of discrete minor dome assemblies each having a curvature substantially greater than the principal curvature of the dome structure, each minor dome assembly having a perimetral configuration substantially congruent to the boundary configuration of the corresponding opening, and each minor dome assembly being connectible essentially along the entirety of its perimeter to the primary network for closing the corresponding opening in a weathertight manner and for transferring to the primary network the load of and applied to the dome assembly.

* * * * *